US005444376A

United States Patent [19]

Dittmann et al.

[11] Patent Number: 5,444,376

[45] Date of Patent: Aug. 22, 1995

[54] SIGNAL-ACQUISITION DEVICE FOR DETECTING A HIGH VOLTAGE SIGNAL AT THE COILS

[75] Inventors: Karl-Heinz Dittmann, Eislingen; Werner Bumen, Kirchheim-Oetlingen, both of Germany

[73] Assignee: Robert Bosch GmbH, Stuttgart, Germany

[21] Appl. No.: 64,020

[22] PCT Filed: Nov. 21, 1991

[86] PCT No.: PCT/DE91/00914

§ 371 Date: May 20, 1993

§ 102(e) Date: May 20, 1993

[87] PCT Pub. No.: WO92/10674

PCT Pub. Date: Jun. 25, 1992

[30] Foreign Application Priority Data

Dec. 15, 1990 [DE] Germany ..... 40 40 236.3

[51] Int. Cl.[6] ..... F02P 17/00

[52] U.S. Cl. ..... 324/402; 324/388

[58] Field of Search ..... 324/380, 382, 388, 399, 324/402, 546, 547; 123/640

[56] References Cited

U.S. PATENT DOCUMENTS

| | | | |
|---|---|---|---|
| 3,921,062 | 11/1975 | Kuhn et al. . | |
| 4,052,665 | 10/1977 | Gruenwald | 324/399 |
| 4,349,782 | 9/1982 | Doss . | |
| 4,758,791 | 7/1988 | Tedeschhi et al. | 324/402 |
| 4,795,979 | 1/1989 | Kreft et al. . | |
| 4,871,970 | 10/1989 | Liebergesell | 324/402 |
| 5,004,984 | 4/1991 | Becker et al. | 324/402 |
| 5,045,796 | 9/1991 | Bentel et al. | 324/399 |

FOREIGN PATENT DOCUMENTS

| | | |
|---|---|---|
| 0032647 | 7/1981 | European Pat. Off. . |
| 3641144 | 6/1988 | Germany . |
| 910945.7 | 12/1989 | Germany . |
| 4018895 | 7/1991 | Germany . |

*Primary Examiner*—Sandra L. O'Shea
*Assistant Examiner*—Roger Phillips
*Attorney, Agent, or Firm*—Spencer, Frank and Schneider

[57] ABSTRACT

A device is provided for detecting high-voltage characteristics in an ignition system having at least two ignition coils. The device includes a plurality of first capacitive signal couplers each being disposed on a respective one of the ignition coils for capacitively extracting a voltage signal from the ignition coil. A circuit arrangement is connected to the plurality of first capacitive signal couplers and includes an output, and a signal combiner for combining the voltage signals extracted from the ignition coils and producing a combined voltage signal at the output. A plurality of second capacitive signal couplers each connected between the signal combiner and a respective one of the first capacitive signal coupler provides for potential isolation between the plurality of first capacitive signal couplers and a further portion of the circuit arrangement.

4 Claims, 1 Drawing Sheet

SIGNAL-ACQUISITION DEVICE FOR DETECTING A HIGH VOLTAGE SIGNAL AT THE COILS

BACKGROUND OF THE INVENTION

The invention is based on a device for detecting signals in an ignition system. The ignition system contains two ignition coils, and a capacitive signal coupling provided on the coils.

U.S. Pat. No. 4,795,979 discloses a device for determining the ignition pulse provided for a specific cylinder of an internal combustion engine. The ignition system contains a plurality of ignition coils, in each case two spark plugs being connected to the secondary windings of the ignition coils. This distributorless ignition system produces an ignition spark at each spark plug at each rotation of the internal combustion engine. In four-stroke internal combustion engines, the ignition sparks are accordingly produced both in the working stroke and in the discharge stroke. For diagnosing this ignition system, three capacitive signal output couplings are provided which are arranged on the ignition cables leading from the ignition coils to the spark plugs. The known device requires the ignition cables to be accessible so that the sensors can be attached. The extracted signals are fed into different signal evaluation circuits.

U.S. Pat No. 3,959,725 discloses the arrangement of a capacitive ignition voltage sensor on a distributor housing which, in addition to the distributor, also contains the ignition coil. The capacitive signal extraction is effected with an electrically conductive surface which is attached to the distributor in a suitable manner. This known device is designed for the diagnosis of a single-coil ignition system.

SUMMARY OF THE INVENTION

The invention is based on the object of disclosing a simple device with a low cabling outlay for the diagnosis of multi-coil ignition systems.

This object is achieved by a circuit arrangement connected to the capacitive signal coupling means. The circuit includes an output and means for combining the signals extracted from the ignition coils. The combined signals are sent to the output. Further, a plurality of second capacitive signal coupling means for potential isolation are provided between the means for combining and a respective ignition coil.

The device according to the invention for detecting signals in an ignition coil system which contains more than one ignition coil has the advantage of simple adaptation. It is particularly advantageous that conventional ignition cables no longer have to be present between the ignition coils and the spark plugs. The means for the capacitive signal extraction are suitably arranged directly on the ignition coils or on the housings which contain the ignition coils. The arrangement for combining the extracted signals, which arrangement is also provided according to the invention, reduces the outlay on cabling. It is only necessary to have connections between the capacitive signal output couplings and the circuit arrangement, from where merely a single ongoing line can be provided. The circuit arrangement is to be arranged in the direct vicinity of the ignition system so that a short line routing, in particular of the single lines leading to the capacitive signal output couplings is possible.

The means for capacitive signal extraction provide signals which correspond in each case to the high voltage at the ignition coils. These signals are combined in the circuit arrangement and can be analysed in a further diagnostic device. The device according to the invention is suitable for diagnosis in multi-coil ignition systems, the secondary windings of the ignition coils being wired as desired. For example secondary windings which are earthed on one side and have a high-voltage terminal can be provided and also arrangements with spark plug terminals at both ends of the secondary windings.

A particularly advantageous further development provides for further capacitive couplings to be provided in each case between the means for capacitive signal extraction and the circuit arrangement for combining the extracted signals. The essential advantage of these further capacitive couplings resides in the potential isolation between the means for capacitive signal extraction and the further circuit arrangement. An adaptation fault which is only present at one ignition or at one ignition coil housing, for example a short-circuit to earth, does not influence the other detected signals. The further diagnostic device can be designed in such a way that the defective or incorrectly connected means for capacitive signal extraction can be identified.

An advantageous further development provides for at least one tuning element to be arranged in the circuit arrangement for calibrating the level of the signal which can be tapped off at the output of the circuit arrangement. It is particularly advantageous if the individual means for capacitive signal extraction are assigned tuning means for calibrating the signal level. By this measure, the signals output by differently designed means for capacitive signal extraction can be calibrated. The signals can then be compared directly with respect to the signal level.

In order to protect against high contact voltages, it is advantageous to provide voltage limiters at the inputs of the circuit arrangement.

The means for capacitive signal extraction can be made easy to handle by designing them as plug-in components. It is expedient to provide plug-in connections on the means, which connections permit rapid changing.

Further advantageous developments and improvements of the device according to the invention result from further subclaims in conjunction with the following description.

DESCRIPTION OF THE PREFERRED EMBODIMENT

Figure 1:
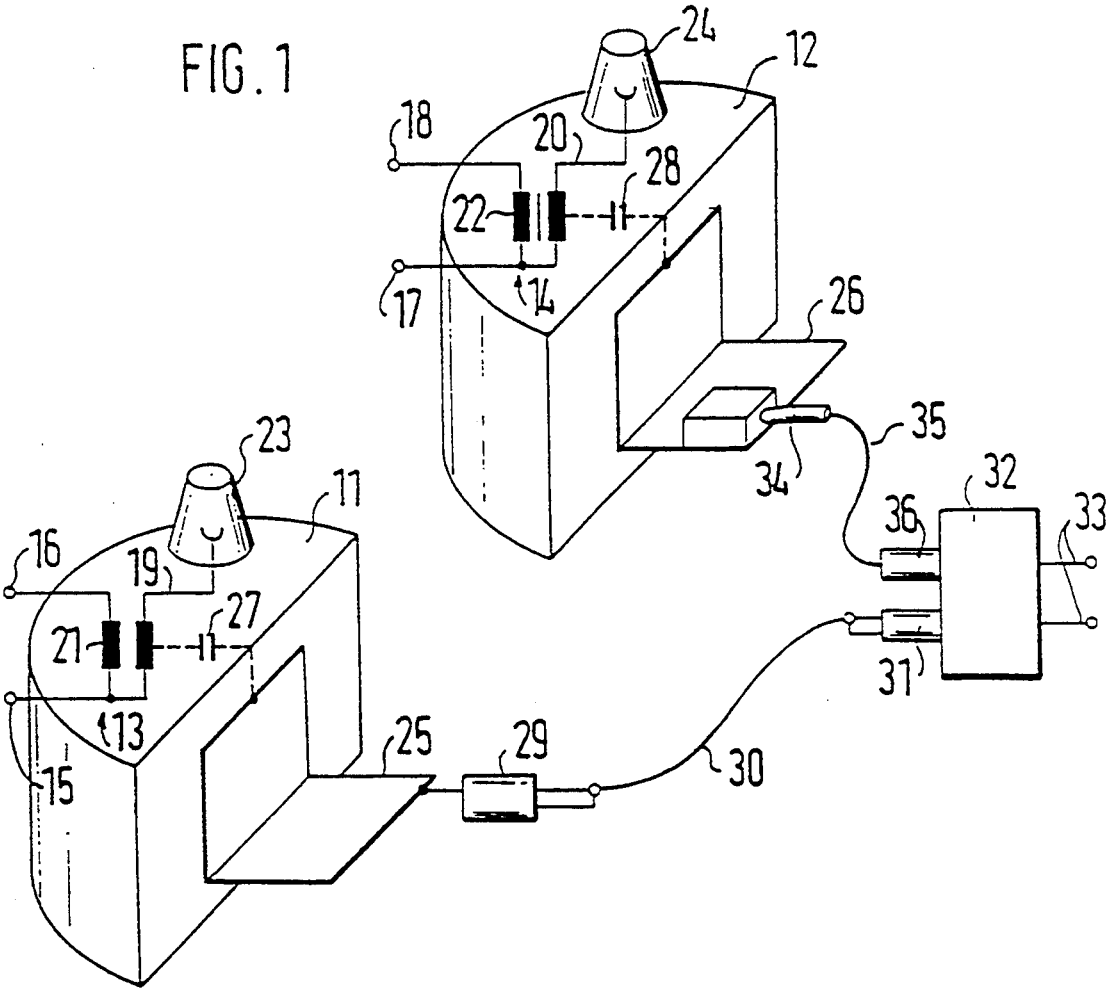
FIG. 1 shows an outline of a device according to the invention for detecting signals in an ignition system.

FIG. 1 shows an ignition system which contains two ignition coils 11, 12. In each case one equivalent circuit diagram 13, 14 of the ignition coil 11, 12 is shown in the ignition coils 11, 12. Primary terminals 15, 16; 17, 18 of the ignition coils 11, 12 lead to the ignition switching devices (not shown in FIG. 1). One secondary terminal 19, 20 of a secondary winding 21, 22 leads in each case to a high-voltage terminal 23, 24.

In each case means 25, 26 for capacitive signal extraction are arranged at the ignition coils 11, 12. The capacitive coupling is illustrated in each case by means of a capacitor 27, 28. Since the capacitor 27, 28 is not present as a separate component it has been shown in FIG. 1 by broken lines.

The means 25 assigned to the ignition coil 11 is connected via a tuning arrangement 29 and a connecting line 30 and via a plug-in connection 31 to a circuit arrangement 32 which has an output 33.

The means 26 assigned to the ignition coil 12 is connected via a plug-in connection 34, a connecting line 35 and a plug-in connection 36 to the circuit arrangement 32.

Figure 2:
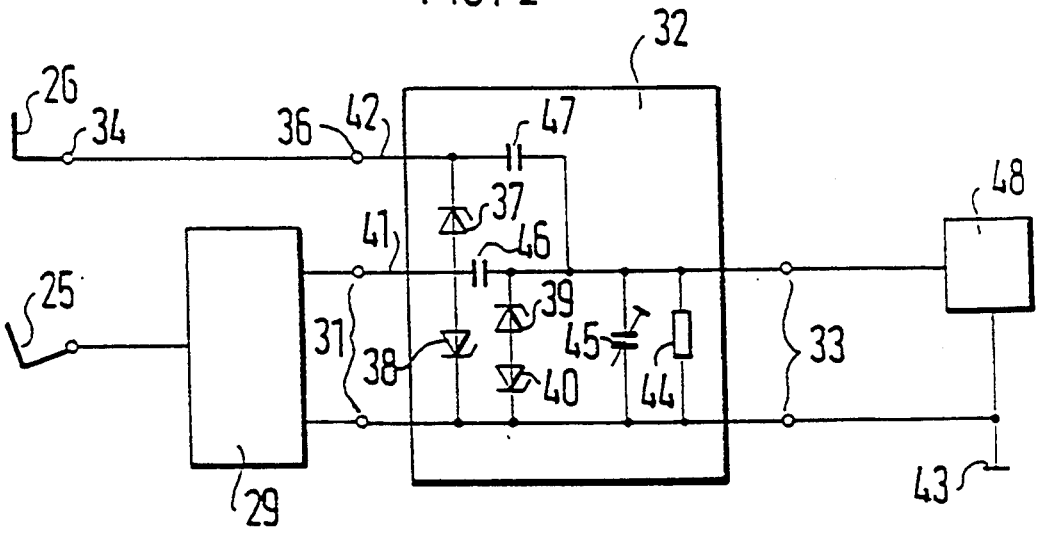
FIG. 2 shows an equivalent circuit diagram.

In FIG. 2 an equivalent circuit diagram of the device illustrated diagrammatically in FIG. 1 is shown. The parts shown in FIG. 2 which coincide with the parts shown in FIG. 1 are provided with the same reference numerals as those in FIG. 1.

The circuit arrangement 32 contains voltage-limiting elements which are composed of in each case two diodes 37, 38; 39, 40. The voltage-limiting elements 37, 38; 39, 40 are each connected between input lines 41, 42 of the circuit arrangement 32 and ground 43. A resistor 44 and a capacitor 45 are connected parallel to the output 33. The inputs 41, 42 are connected to the output 33 via capacitors 46, 47 respectively. The output 33 leads to a further diagnostic device 48.

The device according to the invention operates as follows:

The ignition system contains a plurality of ignition coils 11, 12 which are provided for example for the successively timed ignition of a plurality of cylinders of an internal combustion engine. A conventional distributor is no longer present. In some ignition systems, connecting lines between the ignition coils 11, 12 and spark plugs (not shown in FIG. 1) are no longer accessible. Here, the spark plugs are connected directly to the high-voltage terminals 23, 24. In order, nevertheless, to be able to perform high-voltage measurements on distributorless ignition systems with a plurality of ignition coils 11, 12, according to the invention the means, 25, 26 for capacitive signal extraction are provided. The means 25, 26 are preferably constructed as plug-in parts which can be specially shaped for the purpose of adaptation to different ignition coils 11, 12. The capacitive coupling between the means 25, 26 and the secondary windings 21, 22 of the ignition coils 11, 12 is illustrated by the coupling capacitor 27, 28 which is no longer present as a separate component. Coupling only occurs to the primary side of the ignition coils 11, 12. However, the voltages occurring in the secondary winding 21, 22 are generally higher than those on the primary side by an order of magnitude so that the voltage respectively coupled into the means 25, 26 is always a measure of the voltage occurring on the secondary side of the ignition coils 11, 12.

The signals which are capacitively extracted from the means 25, 26 are combined in the circuit arrangement 32. The means 25, 26 can be connected via connecting lines 30, 35 and via plug-in connections 31, 36 to the arrangement 32. In a simpler embodiment, the plug-in connections 31, 36 can be dispensed with.

The circuit diagram shown in FIG. 2 shows the combination of signals in the circuit arrangement 32. In a very simple embodiment the individual signals can be combined via a galvanic connection. However, capacitors 46, 47 are preferably provided for potential isolating. This measure ensures that incorrect adaptation of a means 25, 26 does not lead to the entire arrangement failing. Protection is provided in particular against a short-circuit of one of the means 25, 26 to ground 43. The capacitor 46, 47 avoid time-consuming searching for the means 25, 26 which is short-circuited to ground. The diagnostic device 48 which further analyses the signals combined at the output 33 easily permits the incorrectly connected means 25, 26 to be identified by reference to a time-related illustration of the signals.

In order to protect an operator against dangerous contact circuit, the voltage arrangement 32 contains voltage-limiting means 37, 38; 39, 40. High-speed limiter diodes 37, 38; 39, 40, which are each connected at the inputs 42, 41 to ground 43, are particularly suitable here. In FIG. 2, the diodes 37, 38; 39, 40 are shown as series circuits with different polarities of the diodes 37, 38; 39, 40. In principle, other wiring configurations are also suitable.

In a different embodiment, the voltage-limiting means 37, 38; 39, 40 can be provided in the tuning arrangement 29. With this arrangement of the means 37, 38; 39, 40, dangerously high voltages can be suppressed near to the source. Capacitive signal couplings in the subsequent circuit arrangement 32 and between lines 30, 35 are minimised.

Adaptation of the signal level or calibration of the entire arrangement is possible with the capacitor 45 which is constructed as a tuning element with variable capacitance. The capacitor 45 forms, together with the equivalent capacitors 27, 28 (shown in FIG. 1), in each case a voltage divider. The relatively high division ratio, which has to reduce the voltages lying in the kV range at the ignition coils 11, 12 to values which can be easily further processed, leads to a relatively high capacitance value of the capacitor 45 so that the variable capacitance of this capacitor 45 can be preferably simulated by parallel and/or series circuits consisting of several capacitors.

The adaptation or calibration to the capacitor 45 has simultaneous effects on the signals lying at the inputs 41, 42. An individual calibration of the individual means 25, 26 is possible with the tuning arrangement 29 which is assigned to the corresponding means 25, 26. The tuning arrangement 29 is joined constructionally for example to the means 25, 26. It contains a matching circuit which is not shown in greater detail in the figures and preferably also contains a capacitive voltage divider. The tuning arrangement 29 is advantageously also to be accommodated in the circuit arrangement 32.

A different embodiment provides for the use of plug-in connections 34 at the means 25, 26. The tuning arrangement 29 here is preferably integrated in the plug-in connection 34. The plug-in connection 34 permits the means 25, 26 to be changed rapidly.

The connecting lines 30, 35 present between the means 25, 26 and the circuit arrangement 32 can be single-conductor lines. Preferably, shielded lines 30 which reduce the coupling-in of interference signals are provided. The cable capacitance present in the shielded lines can be easily taken into account during the calibration of the entire arrangement.

We claim:

1. A device for detecting high-voltage characteristics in an ignition system having at least two ignition coils, comprising:

a plurality of first capacitive signal coupling means each being disposed on a respective one of the ignition coils for capacitively extracting a voltage signal from the ignition coil;

a circuit arrangement connected to said plurality of first capacitive signal coupling means and including an output, and means for combining the voltage signals extracted from the ignition coils and producing a combined voltage signal at the output; and a plurality of second capacitive signal coupling means each connected between said means for combining and a respective one of the first capacitive signal coupling means for potential isolation between the plurality of first capacitive signal coupling means and a further portion of said circuit arrangement.

2. A device as defined in claim 1, wherein said circuit arrangement includes a tuning element for calibrating the combined voltage at said output.

3. A device as defined in claim 1, further comprising a plurality of tuning arrangements each disposed between said means for combining and a respective one of said first capacitive signal coupling means for calibrating the extracted voltage signal.

4. A device as defined in claim 2, further comprising a plurality of tuning arrangements each disposed between said means for combining and a respective one of said first capacitive signal coupling means for calibrating the extracted voltage signal.

* * * * *